United States Patent [19]

Day

[11] 4,179,995

[45] Dec. 25, 1979

[54] SNUBBED RAILROAD CAR TRUCK

[75] Inventor: John C. Day, Hinsdale, Ill.

[73] Assignee: AMSTED Industries Incorporated, Chicago, Ill.

[21] Appl. No.: 849,027

[22] Filed: Nov. 7, 1977

Related U.S. Application Data

[63] Continuation-in-part of Ser. No. 693,092, Jun. 4, 1976, abandoned.

[51] Int. Cl.[2] ..... B61F 5/12; B61F 5/28; B61F 5/46; B61F 5/50

[52] U.S. Cl. ..... 105/197 DB; 105/167; 105/182 R; 105/221 R; 105/222; 105/223

[58] Field of Search ..... 105/182 R, 222, 223, 105/165, 166, 167, 182 R, 218 R, 220, 221 R, 197 DB

[56] References Cited

U.S. PATENT DOCUMENTS

| | | | |
|---|---|---|---|
| 253,439 | 2/1882 | Smith | 105/218 R X |
| 1,029,325 | 6/1912 | Van Sweringen | 105/223 |
| 1,079,980 | 12/1913 | Floyd | 105/220 |
| 1,290,511 | 1/1919 | Cite | 105/223 |
| 1,902,823 | 3/1933 | Bender | 105/218 R |
| 2,668,505 | 2/1954 | Janeway | 105/223 X |
| 2,737,907 | 3/1956 | Janeway | 105/223 |
| 2,744,474 | 5/1956 | Reynolds | 105/223 |
| 2,762,317 | 9/1956 | Palmgren | 105/223 |
| 3,352,255 | 11/1967 | Sheppard | 105/223 X |
| 3,670,660 | 6/1972 | Weber et al. | 105/222 X |

*Primary Examiner*—Stephen G. Kunin
*Assistant Examiner*—Howard Beltran
*Attorney, Agent, or Firm*—John L. Schmitt; Fred P. Kostka

[57] ABSTRACT

A truck for a railroad car includes two spaced side frames which resiliently support ends of a transversely positioned bolster in a window formed in each side frame. On each side of the bolster is a vertical recess formed having opposing convex-shaped sides which engage with end walls of vertical ribs formed on the inner and outer side of spaced sidewalls of the side frame window. In downwardly projecting pedestal jaws formed at each end of each side frame and having selectively spaced sidewalls are journaled axle ends of a front and a rear wheelset. Interposed between each axle end and a roof of the pedestal jaw is a bearing adapter having a convex top surface to engage with a concave surface of the roof of the side frame pedestal jaw. During travel of the truck, a relative rolling movement between the wheelsets, side frames and bolster may occur because of the interaction of the convex sides of the bolster recess with the ribs of the side frame, and because of a like interaction between the convex top surface of the adapter with the roof of the pedestal jaw.

3 Claims, 4 Drawing Figures

SNUBBED RAILROAD CAR TRUCK

This application is a continuation-in-part of an application filed on June 4, 1976, U.S. Ser. No. 693,092, now abandoned.

BACKGROUND OF THE INVENTION

1. Field of the Invention

This invention relates to railroad car trucks and particularly to those trucks allowing relative movement between major components of the truck to occur during travel of the truck.

2. Prior Art

Railroad car trucks in popular use today include spaced side frames resiliently carrying ends of a transversely positioned bolster which in turn supports a body of the railroad car. At ends of each side frame are journaled axle ends of a front and a rear wheelset. Under such an arrangement, movement between the wheelsets, side frame and bolster is limited to rotation of the wheelset about its longitudinal axis and vertical movement between the bolster and the side frame.

Recognizing that while the rigidity of the above-described truck may be desirable while the truck is traveling over a straight section of track, this rigidity is not desirable when the truck must travel about a curved track section and particularly where the curved section is banked to allow a higher rate of travel.

To overcome this rigidity, various modified truck designs have been developed with one such modified truck disclosed in U.S. Pat. No. 2,737,907.

SUMMARY OF THE INVENTION

A railroad car truck of this invention providing a flexible truck structure to allow selective movement of major components of the truck to an out-of-square position includes two spaced side frames. In a window formed in each side frame is an end of a transversely positioned bolster carried on springs supported in turn by a tension member forming a bottom of the side frame window.

The side frame window is further defined by two spaced vertical sidewalls having a vertical rib formed along each sidewall on an inner and an outer vertical wall of the side frame.

On each elongated side of the bolster end is a recess defined by two vertical opposing and inwardly projecting convex-shaped end walls. Each recess contains the sidewall of the side frame window with the ribs of the side frame and convex end walls of the bolster recess so positioned to allow vertical movement therebetween as well as a rolling movement to an out-of-square position. Thus, the side frame may swing or roll about its longitudinal axis and the bolster may rotate or roll about its horizontal axis which is aligned with a longitudinal axis of the railroad car. At the same time, the bolster and side frame are maintained in a squared relation with respect to any yaw movement.

To allow a similar swing or rolling movement between the side frame and a front and rear wheelset of the truck, downwardly projecting pedestal jaws are formed at each end of each side frame. Each jaw is defined by spaced vertical sidewalls and a roof having a transverse concave configuration along its length.

Axle ends of the wheelsets are journaled in the pedestal jaws with a bearing adapter interposed therebetween. A top surface of the bearing adapter has a mating convex configuration to allow rolling engagement between the side frame and the wheelset.

Because of inherent dynamic characteristics of each wheelset to hunt, i.e. oscillate or yaw about a vertical axis of the wheelset during travel of the truck, clearance between the sidewalls of the pedestal jaw and the adapter is selectively chosen with respect to a lateral width of the sidewalls to control this hunting.

There are several important advantages of the truck of this invention over now existing trucks.

Firstly, the major truck components, i.e. side frames, bolsters and wheelsets, remain squared with respect to any yawing movement therebetween.

Secondly, while the major truck components remain squared with respect to yawing, these same major components may independently roll.

While squaring and parallelism on one hand raises a threshold speed for secondary hunting, the rolling or swing motion tends to inhibit the secondary hunting.

Thus, the dynamic ride characteristics of the truck during travel are improved since the truck is better suited to adapt to actual track conditions and load imposed forces.

DESCRIPTION OF THE PREFERRED EMBODIMENT

Figure 1:
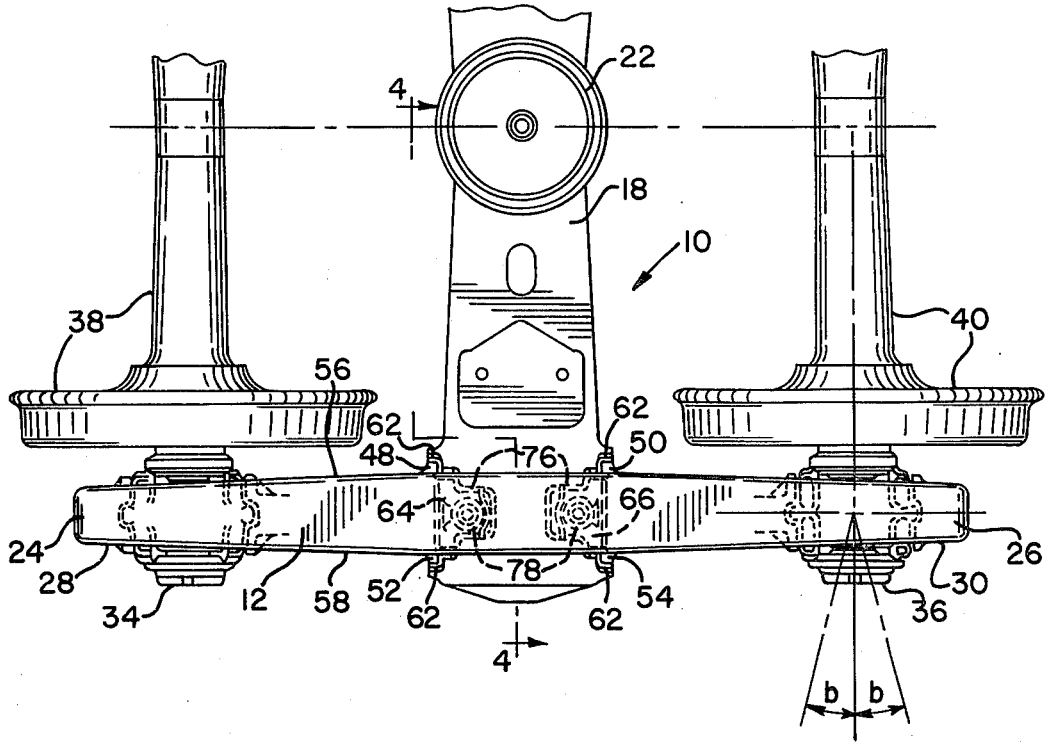
FIG. 1 is a fragmentary plan view of a railroad truck incorporating the present invention.
Figure 2:
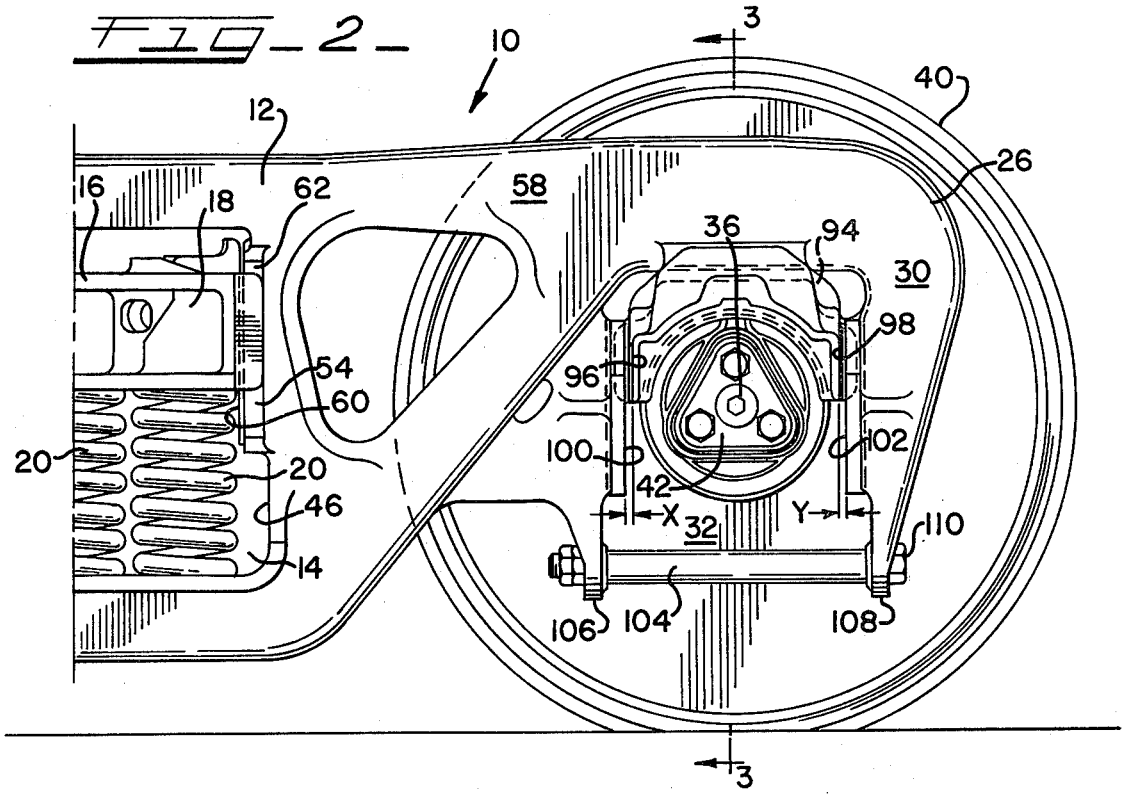
FIG. 2 is a fragmentary elevational view of the railroad truck of FIG. 1.
Figure 3:
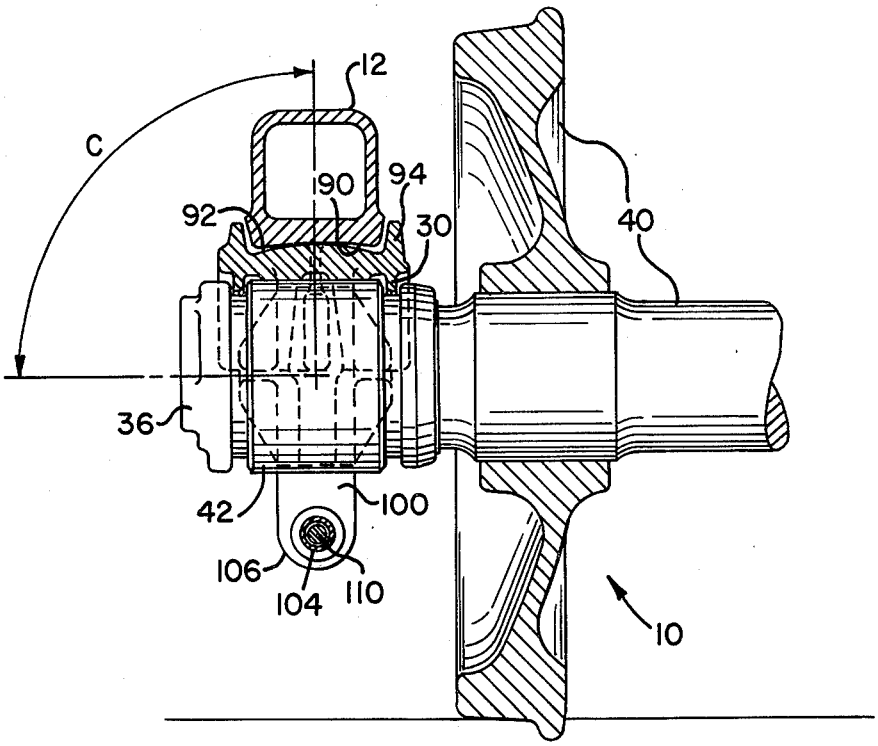
FIG. 3 is a cross-sectional view of the truck taken generally along the line 3—3 of FIG. 2.
Figure 4:
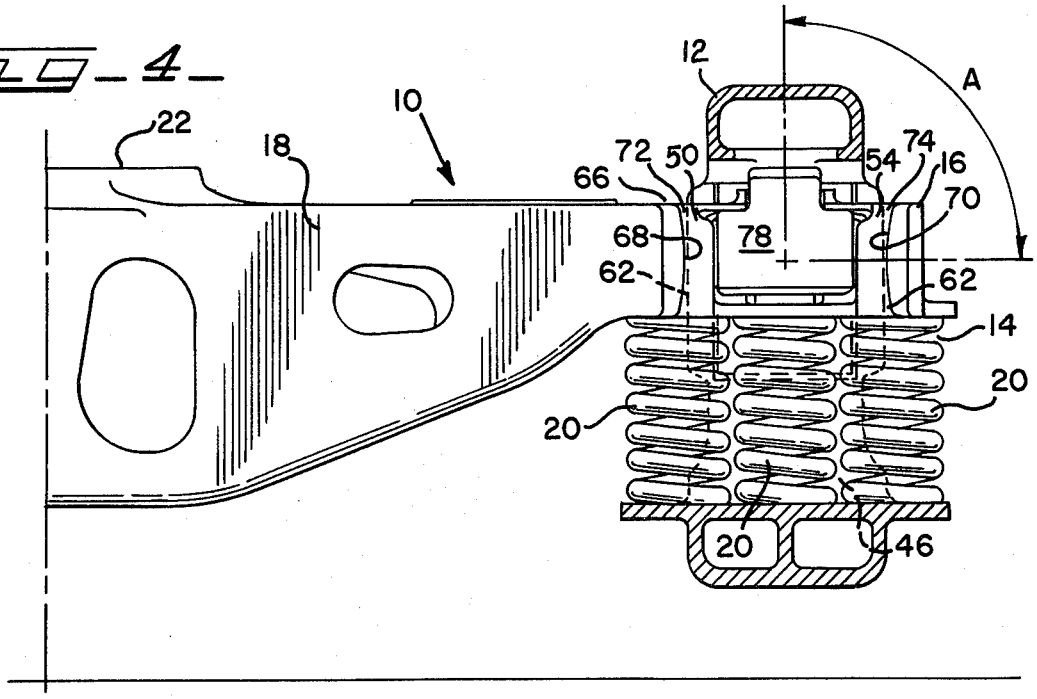
FIG. 4 is a cross-sectional view of the truck taken generally along the line 4—4 of FIG. 1.

A railroad car truck incorporating this invention is shown generally and designated 10. Like most all modern railroad car trucks, the truck 10 includes a pair of spaced side frames with one such side frame shown and designated 12. Within a window 14 formed in the side frame 12 is an end 16 of a transversely positioned bolster 18 supported therein by coil springs 20 which cushion the ride of a body of the railroad car (not shown) supported on a center plate 22 integrally formed as part of the bolster 18.

At ends 24, 26 of the side frame 12 are downward projecting pedestal jaws 28, 30 each defining an opening 32 in which axle ends 34, 36 of a front and a rear wheelset 38, 40 are journaled in bearings 42. It should be understood that the truck 10 is non-directional and front and rear are used as a matter of convenience.

To allow a swing or rolling action, i.e. rotation about a longitudinal axis of the truck 10, between the bolster 18 and the side frame 12 while limiting any yawing action therebetween, i.e. rotation about a vertical axis of the truck 10, the side frame window 14 is formed having a front and a rear spaced vertical sidewall 44, 46. Each sidewall 44, 46 is bounded in part by an inwardly projecting set of vertical ribs 48, 50 and an outwardly projecting set of vertical ribs 52, 54 formed as part of an inner and an outer side 56, 58 of the side frame 12. Each rib 48–54 is defined by a front vertical surface 60 which proximately aligns with the sidewall of the side frame window 14, for example the sidewall 46, and a vertical end surface 62 joining the front surface 60 at a proximate right angle.

In bolster end 16 are formed a front and a rear vertical recess 64, 66 each defined in part by opposing inner and outer end walls 68, 70 each having inwardly projecting convex configuration, an inner and outer offset wall 72, 74 joining the end walls 68, 70 respectively at a proximate right angle and a centrally located bolster pocket 76 to receive a wedge-shaped snubbing device 78.

The front and the rear recesses 64, 66 serve as guides for the front and the rear sidewalls 44, 46 of the side frame window 14 and the related ribs 48–54 to allow a straight vertical movement between the bolster 18 and the side frame 12 and a rolling or swing movement therebetween while limiting any yawing movement.

Thus, assuming that the side frame 12 remains in a vertical plane, the bolster 18 may travel up and down and take an out-of-square position as measured by an angle designated "A". These movements are regulated by the springs 20 and snubbing device 68. During movement to an out-of-square position, a rolling action occurs between the vertical end surface 62 of each rib 48–54 and the inner and outer convex-shaped end walls 68, 70 of the front and the rear recess 64, 66.

In a like manner, assuming that the bolster 18 remains in a horizontal plane, the side frame 12 may roll or swing to an out-of-square position also as measured by the angle "A". In actual practice, it should be understood that the side frame 12 and the bolster 18 each move individually.

Any yawing movement between the side frame 12 and the bolster 18 is limited by interference of the snubbing device 78 with the side frame pocket sidewalls 44, 46 and with the bolster pocket 76, and the vertical front surface 60 of the ribs 48–54 with the inner and outer offset walls 72, 74 of the front and rear recesses 64, 66.

To allow a swing or rolling action between the side frame and the wheelsets, for example between the side frame 12 and the rear wheelset 40, the opening 32 defined by the pedestal jaw 30 has a roof surface 90 being arcuately concave to receive an arcuately convex top surface 92 of an adapter 94 interposed between the bearing 42 and the pedestal jaw 30 of the side frame 12. Note that the radius of surface 92 is less than the surface 90 to allow a rolling movement therebetween having a self-centering characteristic.

Each bearing adapter 94 additionally includes longitudinally spaced vertical end walls 96, 98 fitted between spaced vertical sidewalls 100, 102 of the opening 32 to form a selective clearance space therebetween designated x and y.

It has been found that the desired total clearance, i.e. the sum of x plus y, may be expressed by an equation:

$$\mathrm{Sin}^{-1}\,[x+y/w] \leqq 0.25^\circ \text{ or "}b\text{"}$$

w is the lateral width of the spaced end walls 96, 98 and the angle "b" represents the maximum permissible angle which opposing surfaces, for example the end wall 96 and the sidewall 100, are permitted to assume in moving to an out-of-square position.

In similar conventional railroad car trucks, the clearance (x+y) is normally ⅛ inch and with manufacturing tolerance may vary from 1/16 inch minimum to 5/16 inch maximum. The corresponding out-of-square angle which may occur in such conventional trucks is in the range of about 1°–5°.

According to the present invention and assuming that w is 4½ inch, the total clearance (x+y) is found to be about 0.020 inch. Increasing the effective width, i.e. w, of course, permits a greater total clearance while still maintaining the value of 0.25° out-of-square angling.

To ensure that the desired clearance is maintained, a spacer 104 is fitted between bottom ends 106, 108 of the sidewalls 100, 102 and held therebetween by fastening means 110.

Assuming that the side frame 12 remains in a vertical plane, a wheelset, for example the rear wheelset 40, may take an out-of-square position as measured by an angle designated "C". The out-of-square movement is provided by a rolling action between the convex top surface 92 of the adapter 94 and the concave roof surface 90 of the pedestal jaw 30.

In a like manner, assuming that the rear wheelset 40 remains in a horizontal plane, the side frame 12 may roll or swing to an out-of-square position also as measured by the angle "C". In actual practice, it should be understood that individual movement of the rear wheelset 40 and the side frame 12 occurs. During this swing movement, any yawing movement between the wheelset 40 and the side frame 12 is limited by the sidewalls 100, 102 of the pedestal jaw 28 as regulated by clearance x and y.

While various modifications may be suggested by those versed in the art, it should be understood that I wish to embody within the scope of the patent warranted hereon all such modifications as reasonably and properly come within the scope of my contribution to the art.

What is claimed is:

1. A truck for a railroad car comprising, a pair of spaced side frames, each said side frame including, a side frame window in part defined by spaced sidewalls, a top compression member, and a bottom tension member, vertical ribs formed on an inner and an outer side of each said side frame, said ribs located one each adjacent to said side frame window sidewalls and defined in part by a flat vertical front surface and side surface, and a pedestal jaw formed at ends of each said side frame, said jaw defined by spaced vertical sidewalls and a roof surface having a laterally concaved configuration, bearing adapter means disposed one each in said pedestal jaws to receive in a journaled relationship axle ends of wheelsets of said truck respectively, said adapter means having spaced vertical end walls positioned adjacent to and spaced from said pedestal jaw sidewalls sufficient distance to limit relative horizontal rotational movements between said wheelsets and said side frames to a position slightly out-of-square by interengaging contact between said adjacent pedestal jaw end walls and said adapter sidewalls, and a top surface having a convex configuration having a radius less than a radius of said concave roof surface of said pedestal jaw, said top surface of said adapter means and said roof surface of said pedestal jaw joining to form a rollable self-centering joint between said adapter and said side frame, an elongated bolster positioned transversely to and between said spaced side frames with ends disposed one each in said side frame window and resiliently supported therein by spring means carried by said tension member of said window, each said bolster end including a front and a rear recess having a bolster pocket prepared to receive a snubbing device, offset vertical sidewalls located adjacent to and on each side of said bolster pocket, and opposing convex-shaped end walls, said front and said rear recesses forming a vertical guide for said sidewalls of said side frame window with said ribs engaging with said convex-shaped end walls of said bolster recess to form a rollable joint between said side frame and said bolster, and snubbing means disposed one each in said bolster pockets to in part maintain said bolster and said side frame in a square relationship and to limit yaw movement therebetween.

2. A truck as defined by claim 1 and further characterized by, a spacer means attached to a bottom end of said sidewalls of each said pedestal jaw to maintain said sidewalls in an aligning relationship.

3. In a railroad car truck comprising spaced wheelsets having axle ends rotatively carried by an adapter means respectively, a pair of spaced side frames having a pedestal jaw formed at an outer end of each, respectively, to receive one each of said adapter means and allowing each said side frame to roll with respect to said wheelsets, and a transversely positioned bolster located between and parallel to said wheelsets, ends of said bolster resiliently carried in a window formed in each said side frame, the improvement thereof comprising, ends of said bolster formed having a front and a rear recess defining in part an inner and outer end wall each having a convex configuration projecting into said recess, each said side frame formed having a pair of inner and outer spaced vertical ribs, one each of said ribs positioned adjacent to one each of said bolster recess end walls to provide rolling contact between said side frames and said bolster, and each said side frame pedestal jaw having spaced vertical sidewalls to loosely receive therebetween spaced end walls of said adapter means respectively, said pedestal jaw sidewalls and said adapter means end walls spaced apart a selective distance to allow said wheelsets and said side frames to move to a slightly out-of-square position before an interference occurs between respective pedestal jaw end walls and adapter means sidewalls, wherein during travel of said truck, said wheelsets may more readily move laterally between tracks on which said wheelsets are riding with said lateral wheelset movement being regulated by said rolling contact between said side frames and said bolster.

* * * * *